US009343846B2

(12) United States Patent
Burrow et al.

(10) Patent No.: US 9,343,846 B2
(45) Date of Patent: May 17, 2016

(54) CONNECTOR UNIT

(71) Applicants: Christopher Burrow, Ulverston (GB); Richard Lewin, Ulverston (GB); Christopher Plant, Lancaster (GB)

(72) Inventors: Christopher Burrow, Ulverston (GB); Richard Lewin, Ulverston (GB); Christopher Plant, Lancaster (GB)

(73) Assignee: Siemens Aktiengesellschaft, München (DE)

( * ) Notice: Subject to any disclaimer, the term of this patent is extended or adjusted under 35 U.S.C. 154(b) by 41 days.

(21) Appl. No.: 14/497,694

(22) Filed: Sep. 26, 2014

(65) Prior Publication Data

US 2015/0093931 A1 Apr. 2, 2015

(30) Foreign Application Priority Data

Sep. 27, 2013 (EP) ..... 13186410

(51) Int. Cl.

| | |
|---|---|
| ***H01R 43/26*** | (2006.01) |
| ***H01R 13/627*** | (2006.01) |
| ***H01R 13/523*** | (2006.01) |
| ***H01R 4/48*** | (2006.01) |
| ***H01R 13/52*** | (2006.01) |

(52) U.S. Cl.

CPC ..... *H01R 13/627* (2013.01); *H01R 4/48* (2013.01); *H01R 13/523* (2013.01); *H01R 13/5219* (2013.01); *H01R 13/6276* (2013.01); *H01R 43/26* (2013.01); *Y10T 29/49208* (2015.01)

(58) Field of Classification Search

CPC ..... H01R 13/523; H01R 13/627; H01R 13/5219; H01R 13/6276; H01R 43/26; H01R 4/48

See application file for complete search history.

(56) References Cited

U.S. PATENT DOCUMENTS

| | | | | |
|---|---|---|---|---|
| 4,113,339 | A * | 9/1978 | Eley | H01R 13/53 218/146 |
| 6,511,335 | B1 * | 1/2003 | Rayssiguier | H01R 13/523 385/56 |
| 6,932,636 | B2 * | 8/2005 | Abbey | H01R 13/629 439/138 |
| 7,291,028 | B2 * | 11/2007 | Hall | E21B 17/028 439/192 |
| 2004/0266240 | A1 * | 12/2004 | Abbey | H01R 13/629 439/201 |
| 2005/0075013 | A1 * | 4/2005 | Jennings | H01R 13/523 439/894 |
| 2007/0010119 | A1 * | 1/2007 | Hall | E21B 17/028 439/310 |
| 2011/0207340 | A1 * | 8/2011 | Cairns | H01R 35/04 439/18 |
| 2014/0094051 | A1 * | 4/2014 | McKay | H01R 13/523 439/345 |

FOREIGN PATENT DOCUMENTS

| | | |
|---|---|---|
| EP | 0251655 B1 | 12/1992 |
| EP | 2520757 A2 | 11/2012 |
| GB | 2208337 A | 3/1989 |

(Continued)

OTHER PUBLICATIONS

European search report for European Application No. 13186410.0, mailed Feb. 13, 2014.

*Primary Examiner* — Truc Nguyen

(74) *Attorney, Agent, or Firm* — Lempia Summerfield Katz LLC

(57) ABSTRACT

A connector unit for connecting at least two cables includes at least a male part, a female part, and a shuttle piston. The shuttle piston includes an opening configured for receiving at least a section of the male part, at least one latching device, and at least one latching structure. The male part includes the section configured for insertion into the opening of the shuttle pin, at least one latching aid, and an interaction area configured for a force-fitting interaction with at least one backing latch of the female part. The female part includes the at least one backing latch.

21 Claims, 10 Drawing Sheets

(56) References Cited

FOREIGN PATENT DOCUMENTS

| | | | |
|---|---|---|---|
| GB | 2209550 | A | 5/1989 |
| GB | 2431702 | A | 5/2007 |
| GB | 2490040 | A | 10/2012 |

* cited by examiner

CONNECTOR UNIT

RELATED APPLICATIONS

This application claims the benefit of European Patent Application No. EP 13186410.0, filed Sep. 27, 2013. The entire contents of the priority document are hereby incorporated herein by reference.

TECHNICAL FIELD

The present teachings relate generally to a connector unit for connecting at least two cables, wherein the connector unit includes at least a male part, a female part and a shuttle piston. In some embodiments, the present teachings relate to methods for forming or releasing, respectively, a connection between a male part and a female part of a connector unit.

BACKGROUND

In the near future, there may be increased demand for communication over wide distances (e.g., between continents). Hence, infrastructures (e.g., sea cables and connectors linking sea cables) that are located and operated error-proof in harsh environments (e.g., subsea) will be used. State-of-the-art connectors may use a male pin and a female socket to provide connection. To mate these parts subsea, the male pin may pass through a seal of the female socket without allowing water from the sea into the connector interior. A spring-loaded shuttle piston that fits intimately with a tip of the male pin (e.g., receptacle pin) and is driven back through the seals during the mate has been used. When the connector is de-mated, the spring maintains contact between the male pin (e.g., receptacle) and the shuttle piston, thus preventing water transmission through the seal. This approach uses a spring with a significantly high spring rate to prevent accidental compression of the spring. As a result of the high spring rate, the force significantly increases during the mate. A spring-loaded shuttle pin also increases the length of the connector, causing the connector to be longer than a connector that uses an alternative mechanism for excluding water from the connector.

SUMMARY AND DESCRIPTION

The scope of the present invention is defined solely by the appended claims, and is not affected to any degree by the statements within this summary.

The present embodiments may obviate one or more of the drawbacks or limitations in the related art. For example, in some embodiments, a connector unit for connecting at least two cables that may be operated with minimum force and may be constructed shorter in length as compared to conventional connectors is provided. The connector unit may be reliable and insusceptible to errors.

In some embodiments, methods for forming or releasing, respectively, a connection between a male part and a female part of the above-described connector unit are provided. The methods provide quick, reliable and unfailing mating and/or de-mating of the parts of the connector unit.

In a first aspect, a connector unit for connecting at least two cables (e.g., subsea cables) is provided that includes at least a male part, a female part and a shuttle piston.

The shuttle piston includes an opening configured for receiving at least a section of the male part, at least one latching device configured for forming at least a force-fitting connection between the shuttle piston and the male part, and at least one latching structure configured for forming at least a force-fitting connection between the shuttle piston and the female part. The male part includes the section configured for insertion into the opening of the shuttle pin, at least one latching aid configured for forming at least the force-fitting connection between the shuttle piston and the male part, and an interaction area configured for a force-fitting interaction with at least one backing latch of the female part. The female part includes the backing latch configured for forming at least the force-fitting connection between the shuttle piston and the female part, and further configured for interacting at least with the interaction area of the male part in a force-fitting interaction.

In accordance with the present teachings, a mating and/or de-mating of the male and female parts of the connector unit may be performed with reduced risk of failure of the connector unit (e.g., by accidental entry of water into the connector unit) as compared to conventional systems. Thus, a reliable and error proof connector unit may be provided that offers properties desirable for subsea applications. Moreover, mating and de-mating forces are minimized and occur only during the latch and/or de-latch process. Furthermore, a length of the connector unit is reduced in comparison with other connectors. This reduction in length occurs because the shuttle piston is no longer driven by a spring that is stored in the mated (compressed) position.

Even if terms such as "cable," "male part," "female part," "shuttle piston," "opening," "section," "latching device," "latching structure," "latching aid," "interaction area," "backing latch," "pin," "lubricating device," "flow channel," "contact surface," "chamfer," "groove," "contour," "seal," "tip," and the like are used in the singular or in a specific numeral form in the claims and the specification, it is to be understood that the scope of the present teachings is not restricted to the singular or specific numeral form. More than one or a plurality of the above-described structure may be present.

The phrase "connector unit" refers to a unit that physically connects at least two cables (e.g., subsea cables). Thus, the connector unit may be a subsea connector unit. The connector unit may be used in any harsh environment and may be provided as an electrical connector and/or penetrator or as a wet mateable connector. Moreover, the connector unit may be employed in a high voltage application.

A female part or socket or plug or connector body refers to a part of the unit with an opening, recess, or bore configured to receive another part of the connector unit, such as the male part or the shuttle piston or parts thereof. Thus, a male part or receptacle pin refers to a part of the unit with a pin, extension, or the like configured to engage or be inserted in the opening of the female part. The female and male parts are configured to establish an electrical connection in case of mating of the male and female part. The female and male parts each may be encased in a casing or an exterior of a cable. Moreover, the male and female parts may be locked together once fully mated, for example, by a lock or clamp on external metalwork.

A shuttle piston or shuttle pin refers to a part of the unit that supports, facilitates, or mediates the connection between the female and the male part of the unit. The shuttle piston provides a secure, sealed, and—in the case of a watery environment—a leakage-free mating of the male and female parts. The shuttle piston has a shell that is machined out of a single piece of steel to provide a continuous, smooth surface. The front seals of the female part through which the shuttle piston passes will maintain a good seal throughout the mate/de-mate process. An opening refers to a recess, bore, clearance, blind hole or the like configured to accommodate a section of the male part. The section may pass through the opening or rest in the opening. A section of the male part refers to a pin, an extension, a protrusion, or a part configured to engage or be inserted in the opening of the shuttle piston.

A latching device, a latching structure, a latching aid, or a backing latch refers to a device configured to form a removable connection between the male part and the shuttle piston or the female part and the shuttle piston, respectively, and/or configured to act with a snap fit during the latching. Representative structures that may be used include but are not limited to a pin, a groove, a hook, a frictional or arresting material, and the like. Moreover, the latching structure and the backing latch are configured to provide a mechanical latch between the female part and the shuttle piston during the engagement or dis-engagement of the male part and the shuttle piston (e.g., during the insertion/withdrawal of the section of the male part into the opening of the shuttle piston). The latching device and the latching aid are configured to provide a mechanical latch between the male part and the shuttle piston during movement of the male part relative to the female part.

The phrase "at least a force-fitting connection" refers to an additional form-fitting connection between the male part and the shuttle piston or the female part and the shuttle piston, respectively. In some embodiments, a combination of a force-fitting connection and a form-fitting connection may be used.

An interaction area refers to an area that provides a connection (e.g., a tight and secure connection) or a force-fitting connection between at least the male part and the backing latch of the female part during the movement of the male part relative to the female part. In some embodiments, the interaction area may be a machined or coated surface, a groove or a pin, or the like. The interaction between the interaction area and the backing latch may be a force-fitting connection that allows a gliding motion of the backing latch pin on the interaction area. The shuttle piston may be provided with a similar or equal interaction area. The backing latch may interact with both interaction areas at the same time or first with one interaction area and subsequently with the other interaction area. In some embodiments, the backing latch interacts first with the interaction area of the shuttle piston and second with the interaction area of the male part.

In some embodiments, the engagement force for the latching device and the latching aid is less than the disengagement force of the backing latch with the latching structure. This configuration allows the male part and shuttle piston to be bound together before entry into the female part.

The shuttle piston is "latched" onto a front of the male part/receptacle pin during the early stages of the mating process. Thus, the movement of the male part/receptacle pin pushes the shuttle piston back into the female part/connector body and pulls the shuttle piston back out again. The shuttle piston is then "caught" by the backing latch, thus preventing the shuttle piston from moving further and forcing the latch between the male part/receptacle pin and the shuttle piston to disengage.

The latching device includes at least one spring-loaded pin (e.g., latch pin) that is arranged basically radial with respect to an axis of the shuttle piston. Thus, a reliable and space-saving construction may be obtained. Furthermore, the latching/de-latching force of the latching device may be readily selected by choosing a suitable spring force. The "basically radial" configuration of the pin with respect to an axis of the shuttle piston includes a divergence from the strictly radial arrangement of about 30°. In some embodiments, the pin is oriented radial (90°) or perpendicular to the axis of the shuttle piston. The axis of the shuttle piston and the axis of the male and female part is arranged parallel to a direction of movement of the male part. The pin may extend into the opening at a mantel surface of the opening.

The latching device may further include a plurality of spring-loaded pins. A homogeneous latching/de-latching may thus be achieved. More pins provide a greater redundancy while increasing complexity. The pins may be arranged in any suitable pattern including randomly or evenly distributed along an inner circumference of the shuttle piston (e.g., mantel surface). In this configuration, forces acting on the section of the male part are constant over the circumference, thereby resulting in missing pressure peaks at the male part and conserving the construction and material of the male part.

To construct the assembly, each latch pin is inserted into a hole/bore in an assembly holder providing a channel guiding the pin. A backing spring is placed into a recess behind the pin. The spring and pin are secured in place by a latch pin spring base that is screwed into a thread in the holder. The base is also used to apply the correct compression to the spring. Additionally, a stepped flange prevents the latch pin from moving too far into the hole and is the same depth as the length of the anticipated travel of the latch pin. Thus, even when the pin is fully depressed, a gap cannot open to allow sediment to get behind the pins hole. A radially outer section of the pin is threaded for easy insertion into the shuttle piston shell.

In some embodiments, the latching device includes at least one security device. The security device may include at least one flow channel that is equipped to carry water to prevent hydraulic locking of the spring-loaded pin. Thus, a failure of the pin may be prevented, thereby providing a reliable mating and/or de-mating. The term "equipped" refers to specially provided and/or designed. In case of water entering a channel that is guiding the spring-loaded pin, during mating of the male part and the shuttle piston and thus blocking a radial movement of the spring-loaded pin, the water may exit the channel via the security device or the flow channel, respectively.

In some embodiments, the latching device includes at least one mating/engagement chamfer with a gentle engagement angle with respect to an axis of the shuttle piston. Consequently, the latching/mating force of the latching device may be selected by choosing a suitable chamfer. Due to a gentle angle, the friction between parts during the mate may be reduced and the mating force minimized. In this context, the term "gentle" refers to an angle with a value between about 179° and about 160°, in some embodiments between about 175° and about 165°, in some embodiments between about 173° and about 171°, and in some embodiments of about 172° with respect to the axis of the shuttle piston. The mating chamfer angle is configured to support the mating of the male part and the shuttle piston. Furthermore, the mating chamfer contacts a part of the male part in the mated position. The chamfer provides an inclined plane, thus facilitating a pushing movement of the section of the male part into the opening of the shuttle piston, thereby initiating the mating of the male and female parts (de-latching of a backing latch via compression of one or more backing latch backing springs).

In some embodiments, the latching device includes at least one de-mating chamfer with a steep dis-engagement angle with respect to an axis of the at least one shuttle piston. Hence, the de-latching/de-mating force of the latching device may be selected by choosing a suitable chamfer. By using a steep angle, a friction between parts during the dis-engagement may be increased, thereby increasing the force needed for the de-mating. Hence, accidental separation of the parts may be prevented or does not occur at the wrong stage of the de-mate process. The force is selected to be a balance between preventing the separation while still being low enough to allow facile separation of the components when desired. The term "steep" refers to an angle with a value between about 30° and about 85°, in some embodiments between about 40° and about 60°, in some embodiments between about 45° and about 55°, and in some embodiments of about 50° with respect to the axis of the shuttle piston. The dis-engagement chamfer angle is configured to support the de-mating/dis-engagement of the male part and the shuttle piston. Moreover, the dis-engagement chamfer contacts a part of the male part in the mated position. The chamfer provides an inclined plane, such that a pulling movement of the section of the male part out of the opening of the shuttle piston initiates the actuation of the pin (e.g., release of the spring force of the backing spring).

The force used to engage and disengage each pin may be controlled through the two chamfer angles and the stiffness and compression of the backing spring. Larger forces may be achieved by increasing the chamfer angle and by using a stiffer spring under greater compression, whereas lower forces may be achieved in the opposite manner.

In some embodiments, the latching aid of the male part is provided as at least one groove that extends in a circumferential direction of the male part. The latching aid may be constructed easily. Moreover, by providing the groove to accommodate the spring-loaded pin in a force-fitting and basically form-fitting manner, the connection is robust and axially fixed. The term "accommodate" refers to being received and/or held. In this context, the phrase "in a basically form-fitting manner" refers to the contours of the groove and the pin corresponding in shape to each other by at least about 30%, in some embodiments by at least about 50%. After engagement, the pin or pins hold the groove and thus the male part in an axially fixed position.

As described above, the groove has a contour (e.g., dis-engagement chamfer) that is complementary to the contour of the pin (e.g., at least one contour of the spring-loaded pin, such as the dis-engagement chamfer). Hence, the pulling movement of the section of the male part out of the opening of the shuttle piston is facilitated. The contour has a steep chamfer angle for dis-engagement of the groove and the pin or pins. The male part has an additional contour (e.g., mating chamfer) that is complementary to the contour of the pin and at least one contour of the spring-loaded pin, such as the mating chamfer. The additional contour of the male part is located at the section or the protrusion and has a gentle chamfer angle configured for engagement of the protrusion and the pin or pins.

In some embodiments, the shuttle piston includes at least one dirt seal that is mounted in the opening of the shuttle piston and is configured to prevent entry of dirt, sediment, grit, or the like into the shuttle piston. As a result, an interference with operation of the pin or pins or blocking of the pin or pins may be prevented, thereby providing proper functioning and continued operation of the latching device (e.g., in dirty water). The dirt seal is a rubber ring mounted on a steel carriage that is driven forward by a light spring. The rubber ring may be flexible enough to pass the latch pin or pins but be stiff enough to remain upright at the front of the opening. The dirt seal carriage will catch on the dis-engagement chamfer of the latch pin or pins to prevent the seal from extruding beyond the opening of the shuttle piston (e.g., against the movement direction).

In some embodiments, the backing latch of the female part provides a releasable connection between the shuttle piston and the female part. Thus, the movability of the shuttle piston and the male part may be easily constructed and controllable by the backing latch.

In some embodiments, the backing latch includes at least one spring-loaded pin that is arranged basically radial with respect to an axis of the female part. Thus, a reliable and space-saving construction may be obtained. Furthermore, the latching/de-latching force of the backing latch may be selected easily by choosing a suitable spring force. Any number of pins may be used. The pins may be arranged randomly or evenly distributed along an inner circumference of an assembly holder for the pins. A plurality of pins may provide greater redundancy while increasing complexity.

In some embodiments, the latching structure of the shuttle piston is provided as at least one groove that extends in a circumferential direction of the shuttle piston. The latching structure may be easily constructed. The spring-loaded pin of the female part may be configured to latch with the groove of the shuttle piston, wherein the pin or pins hold the groove and thus the shuttle piston in an axially fixed position. Hence, a strong and stationary connection may be provided that locks the shuttle piston securely in place during the mating or de-mating of the male part.

To construct the backing latch assembly, each backing latch pin is inserted into a hole in the assembly holder, thereby providing a channel guiding the pin, and a spring is placed into a recess behind the pin. The spring and pin are secured in place by a latch pin spring base that is screwed into a thread in the holder. The base is also used to apply the correct compression to the spring. A stepped flange at the bottom of the hole prevents the backing latch pin or pins from moving too far into the bore. A lubricating device, such as an oil flow channel, may be provided to prevent hydraulic locking of the backing latch pin or pins.

In some embodiments, the backing latch includes at least one chamfer configured to support either the dis-engagement or the locking of the connection between the shuttle piston and the female part. In case of the dis-engagement, the chamfer has a gentle dis-engagement angle. Thus, dis-engagement force of the backing latch may be easily selected by choosing a suitable chamfer. In this context, the term gentle refers to an angle with a value between about 175° and about 100°, in some embodiments between about 165° and about 120°, in some embodiments between about 155° and about 130°, and in some embodiments of about 150° with respect to the axis of the female part.

The force used to disengage each backing latch pin may be controlled through the dis-engagement chamfer angle and the stiffness and compression of the backing spring. Larger dis-engagement forces may be achieved by increasing the chamfer angle and by using a stiffer spring under greater compression.

The chamfer for locking has a vertical or over vertical locking angle. In this context, a vertical or over vertical angle refers to an angle with a value between about 90° and about 135°, in some embodiments between about 95° and about 120°, in some embodiments between about 95° and about 110°, and in some embodiments of about 100° with respect to the axis of the female part. This chamfer may provide an anti-extrusion chamfer because, by using the vertical or over vertical angle, the shuttle piston cannot extrude from the connector body (e.g., female part) without shearing the backing latch pin or pins.

Moreover, the groove of the shuttle piston has a contour that is complementary to a contour of the spring-loaded pin of the backing latch. Hence, the groove of the shuttle piston has the same profile as the backing latch pin to provide a smooth engagement and dis-engagement. The shuttle piston further includes a lip that is located adjacent to the groove when viewed in a moving direction of the male part during a connecting process. The lip is recessed slightly in a radial direction towards the axis of the shuttle piston, such that the lip does not interfere with any other features within the connector body (e.g., internal stress control moldings, a multilam in the contact copper work of the female socket, seals, or the like), during the insertion or withdrawal of the shuttle piston and the male part.

In some embodiments, the spring-loaded pin of the backing latch includes at least one rounded tip or point. Hence, a smooth connecting surface may be provided. In some embodiments, the shuttle piston and/or the male part includes at least one planar surface, wherein the rounded tip of the spring-loaded pin is configured to engage the planar surface in a force-fitting manner. Consequently, the backing latch pin or pins will not catch on the interface between the receptacle pin (e.g., male part) and the shuttle piston.

In some embodiments, a method for forming a connection between a male part and a female part of a connector unit using a shuttle piston of the connector unit is provided.

The method includes pushing or moving at least a section of the male part (e.g., pin) into an opening of the shuttle piston until at least a force-fitting connection—and, in some embodiments, a form-fitting connection as well—between the shuttle piston and the male part is formed by a latching mechanism (e.g., via a latching device) of the shuttle piston. Thus, a fixed connection is provided between the shuttle piston and the male part, wherein the shuttle piston is locally fixed in at least a force-fitting manner—and, in some embodiments, in a form-fitting manner as well—at the female part by a backing latch of the female part during the insertion of the section of the male part into the opening of the shuttle piston. The method further includes moving the male part with the connected shuttle piston (e.g., in a moving direction) relative to the female part, thereby unlatching at least the force-fitting connection—and, in some embodiments, the additional form-fitting connection as well—between the female part and the shuttle piston until the female part connects at least the shuttle piston (or the male part) in a force-fitting manner (e.g., by the backing latch), thereby providing a fixed connection between the male part and the female part.

In accordance with the present teachings, a mating of the male and female parts of the connector unit may be performed with reduced risk of water accidentally entering the connector unit as compared to conventional systems. Moreover, due to minimized mating forces, the latch process may be easily performed.

The pushing or moving of the section of the male part may be performed against a pressure of a spring, wherein the spring loads the dirt seal to prevent dirt from entering the opening of the shuttle piston.

In some embodiments, a method for releasing a connection between a male part and a female part of a connector unit using a shuttle piston of the connector unit is provided.

The method includes moving the male part with the connected shuttle piston (e.g., against a moving direction) relative to the female part until at least a force-fitting connection—and, in some embodiments, additionally a form-fitting connection—between the shuttle piston and the female part is formed by a backing latch of the female part. Thus, a fixed connection between the shuttle piston and the female part is provided, wherein the male part is locally fixed in at least a force-fitting manner—and, in some embodiments, in a form-fitting manner as well—into an opening of the shuttle piston by a latching mechanism (device) of the shuttle piston during the moving of the male part relative to the female part. The method further includes moving (e.g., pulling) the male part (e.g., against the moving direction) relative to the shuttle piston (and female part) until at least the force-fitting connection—and, in some embodiments, the form-fitting connection as well—between the shuttle piston and the male part formed by the latching mechanism (via the latching device) of the shuttle piston is unlatched, thereby disconnecting the male part from the female part.

In accordance with the present teachings, a de-mating of the male and female parts of the connector unit may be performed with reduced risk of water accidentally entering the connector unit as compared to conventional systems. Moreover, due to minimized de-mating forces, the de-latch process may be easily performed.

After de-latching the latching mechanism of the male part and the shuttle piston, the section of the male part is removed from the opening of the shuttle piston and the dirt seal is pushed against the moving direction by the preloaded spring. The seal prevents dirt from entering the opening of the shuttle piston.

In some embodiments, a shuttle piston with the above-described characteristics may be used in the connector unit and methods in accordance with the present teachings. A connection between the male part and the female part may be efficiently supported, thereby resulting in a smooth and reliable mating and/or de-mating process.

The above-described characteristics, features, and advantages of the present teachings, and the manner in which they are achieved, are clear and clearly understood in connection with the following description of exemplary embodiments that are explained in connection with the drawings.

DETAILED DESCRIPTION

Figure 1:
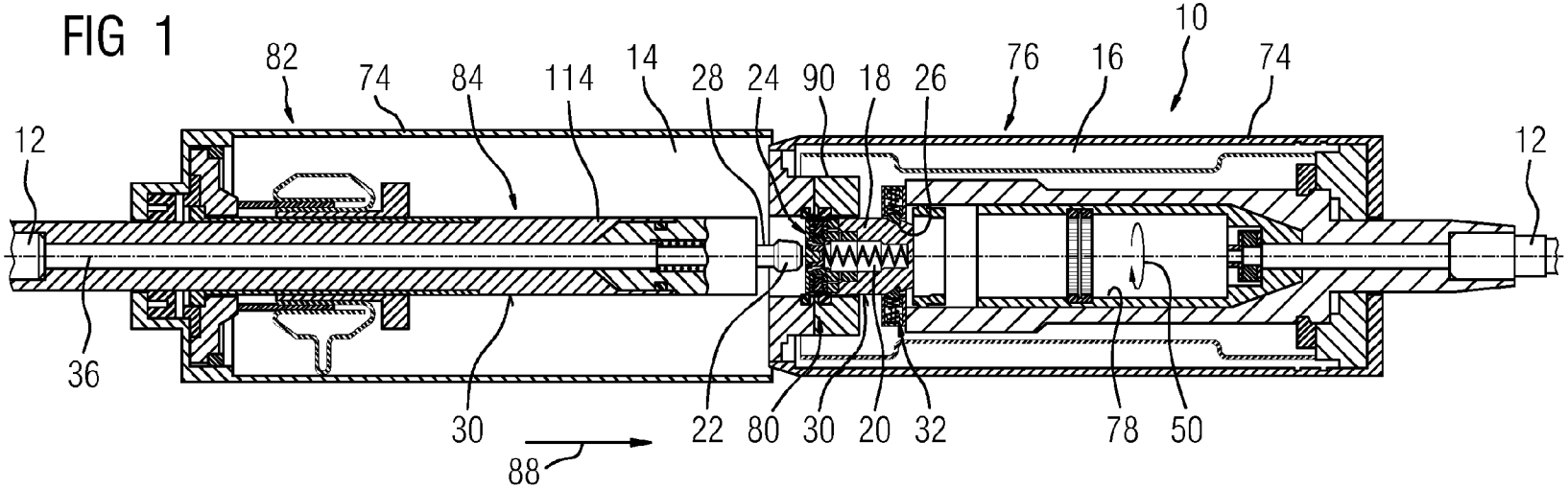
FIG. 1 shows a cross-sectional view of an example of a subsea connector unit with a male part, a female part, and a shuttle piston prior to mating.

The illustrations in the drawings are schematic. In different figures, similar or identical elements are provided with the same reference signs.

FIG. 1 shows a high voltage subsea connector unit 10 for connecting two subsea cables 12 in accordance with the present teachings. The connector unit 10 includes a male part 14 and a female part 16 (of the cables 12 only the connecting regions are illustrated). Both the male part 14 and the female part 16 are encased in a housing 74 that will be axially aligned during a mating or de-mating process of the male part 14 and female part 16. The female part 16 is located at a plug front end 76 of a first subsea cable 12 and includes an axially extending bore 78 with seals 80 configured for preventing entry of water or dirt into the interior of the female part 16. The male part 14 is located at a receptacle front end 82 of the second subsea cable 12 and includes a receptacle pin assembly 84.

Figure 2:
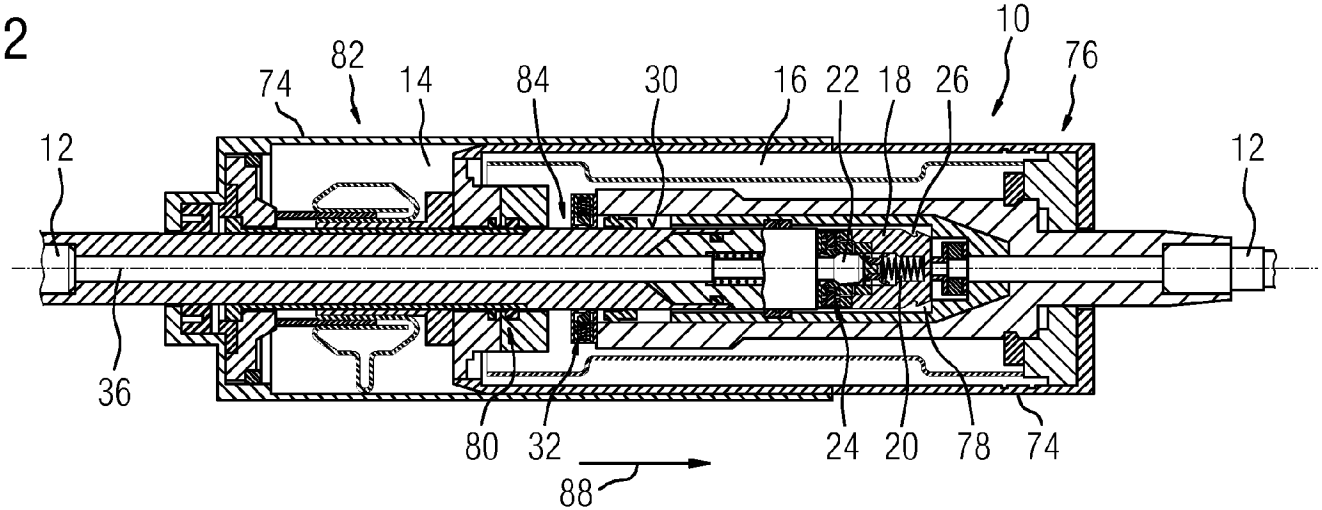
FIG. 2 shows a cross-sectional view of the exemplary subsea connector unit of FIG. 1 in a mated position.

For a mating of the male part 14 and female part 16, the bore 78 and the receptacle pin assembly 84 will be arranged vertically aligned towards each other, such that by moving the receptacle pin assembly 84 in a direction of the female part 16—for example, a moving direction 88—the receptacle pin assembly 84 may partially enter the bore 78 of the female part 16. Due to a proper positioning of the receptacle pin assembly 84 in the bore 78 of the female part 16, an electrical connection is formed. This mating position is shown schematically in FIG. 2.

The connector unit 10 further includes a shuttle piston 18 configured to support the connection between the male part 14 and the female part 16. Moreover, the shuttle piston 18 is configured to keep water out of the female part 16 of the high voltage subsea connector unit 10. The shuttle piston 18 is inserted into a front end 90 of the bore 78 of the plug front end 76. In the unmated position, a front of the shuttle piston 18 is flush with the front of the electrically female part 14. To secure the shuttle piston 18 axially inside the bore 78, the female part 16 includes a backing latch 32 configured for forming a force-fitting and form-fitting connection between the shuttle piston 18 and the female part 16.

FIGS. 3 to 7 show an assembly holder 92 of the backing latch 32 in various views. The assembly holder 92 is constructed as an annular structure that extends, when mounted in the female part 16, in a circumferential direction 50 of the bore 78 of the female part 16 shown in FIG. 1. The backing latch 32 includes a plurality of spring-loaded pins 60 that are evenly distributed along a circumference 56 of the assembly holder 92.

Figure 3:
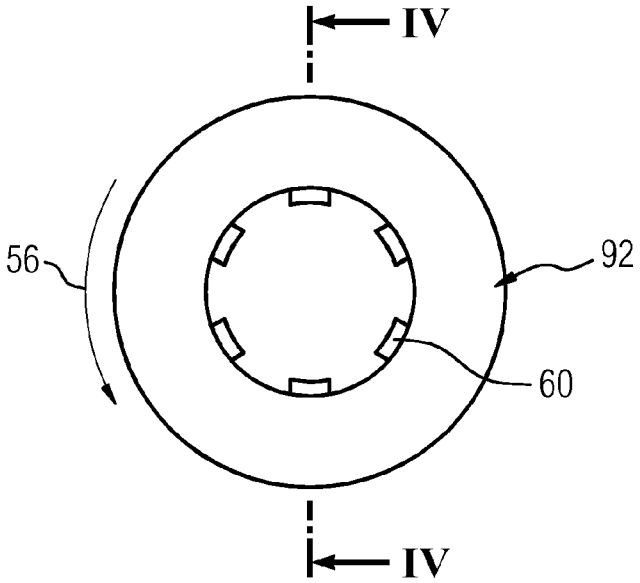
FIG. 3 shows a front view of an example of an assembly holder of a backing latch of the female part in FIG. 1.
Figure 4:
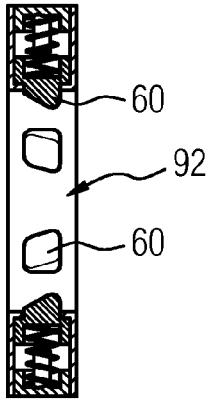
FIG. 4 shows a cross-section taken along line IV-IV through the exemplary assembly holder in FIG. 3.
Figure 5:
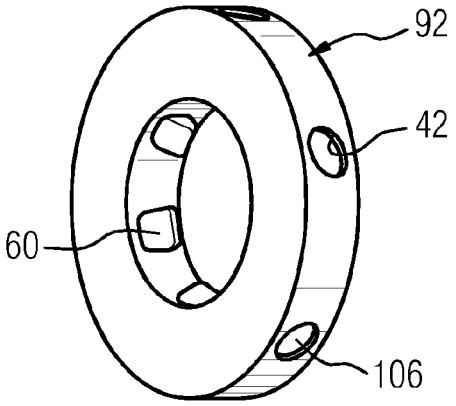
FIG. 5 shows a first perspective vie of the exemplary assembly holder of FIG. 3.
Figure 6:
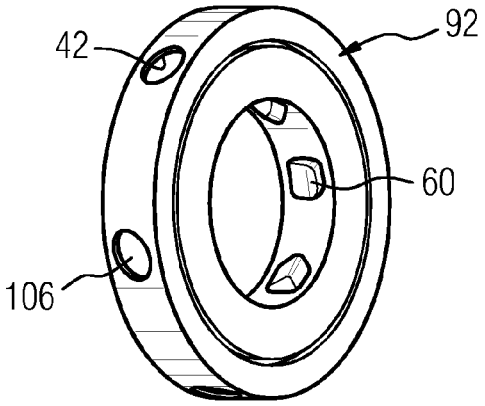
FIG. 6 shows a second perspective view of the exemplary assembly holder of FIG. 3.
Figure 7:
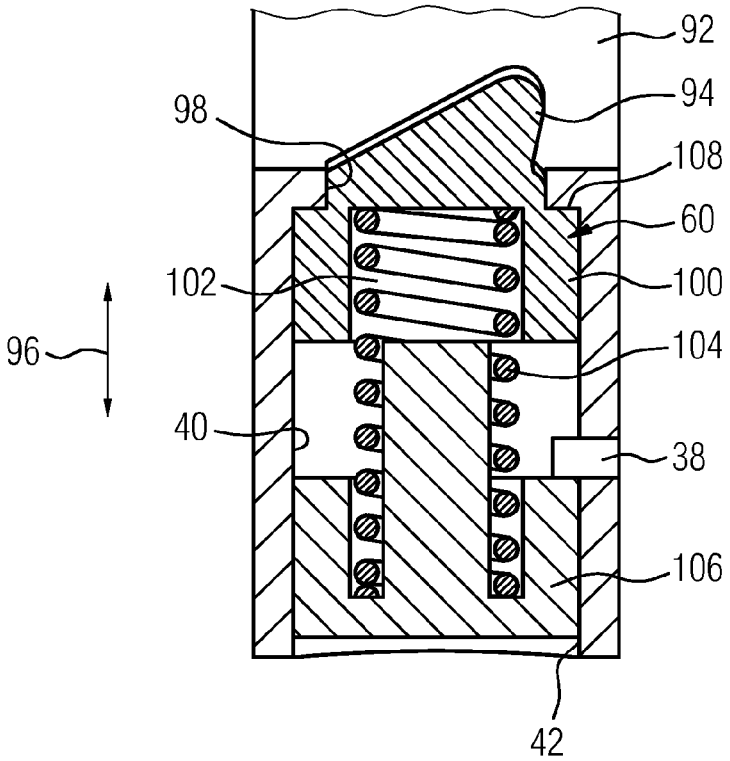
FIG. 7 shows a partial cross-sectional view of the section through the exemplary assembly holder of FIG. 4.

FIG. 7 shows a cross-section through a lower part of the assembly holder 92 taken along line IV-IV of FIG. 3. As shown in FIG. 7, each spring-loaded pin 60 is arranged in a mounted state in the female part 16 basically radial with respect to an axis 36 of the female part 16 shown in FIG. 1. A radially inner end 94 of the pin 60 extends in a radial direction 96 through a clearance 98 of the assembly holder 92. A radially outer end 100 of the pin 60 extends in a channel 42 and features a recess 102 to accommodate a spring 104 to bias the pin 60.

To construct the assembly, each backing latch pin 60 is inserted into the channel 42 in the assembly holder 92, and the spring 104 is placed into the recess 102 behind the inner end 94. The spring 104 and the pin 60 are secured in place by a latch pin spring base 106 that is screwed into a thread (not shown in detail) in the holder 92. The base 106 is also used to apply the correct compression to the spring 104. A stepped flange 108 at a radially inner bottom of the channel 42 prevents the pin 60 from moving too far into the bore 78 of the female part 16. The backing latch 32 or the assembly holder 92 includes a lubricating device 38 in the form of an oil flow channel 38. The oil flow channel 38 is configured for feeding a lubricant to a contact surface 40 between the spring-loaded pin 60 and the channel 42 guiding the spring-loaded pin 60 to prevent hydraulic locking of the pins 60.

Figure 8:
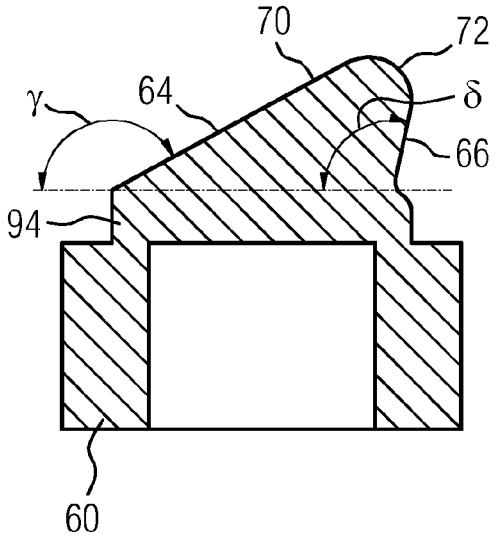
FIG. 8 shows a cross-sectional view through a pin of the exemplary backing latch of FIG. 3.

FIG. 8 shows a cross-section through a pin 60. The pin 60 of the backing latch 32 includes a first chamfer 64 with an angle $\gamma$ and a second chamfer 66 with an angle $\delta$. The angles $\gamma$ and $\delta$ are selected for the functions of the first chamfer 64 and the second chamfer 66. The angle $\gamma$ of first chamfer 64 is a gentle dis-engagement angle with an inclination angle of about 150° with respect to the axis 36 of the female part 16 shown in FIG. 1. The angle $\delta$ of second chamfer 66 is a vertical or over-vertical anti-extrusion angle with an inclination angle of about 100° with respect to the axis 36 of the female part 16. In a mounted state of the assembly holder 92, at the female part 16, the first chamfer 64 for dis-engagement faces towards the male part 14 and the second chamfer 66 for locking faces a contrariwise direction. The function of the first chamfer 64 and the second chamfer 66 is to allow a mating and a de-mating of the shuttle piston 18 from the female part 16. Thus, the backing latch 32 of the female part 16 provides a releasable connection between the shuttle piston 18 and the female part 16. In addition, the backing latch 32 may prevent the shuttle piston 18 from extruding out of the female part 16 (e.g., against the moving direction 88) and provide a resistive force to facilitate detachment of the male part 14 at the end of the de-mating process.

The force used to disengage each pin 60 may be controlled through the dis-engagement chamfer angle $\gamma$ and the stiffness and compression of the backing spring 104. Larger dis-engagement forces may be achieved by increasing the chamfer angle $\gamma$ and by using a stiffer spring 104 under greater compression. In this design, the shuttle piston cannot extrude from the female part 14 without shearing the backing latch pins 60.

Figure 9:
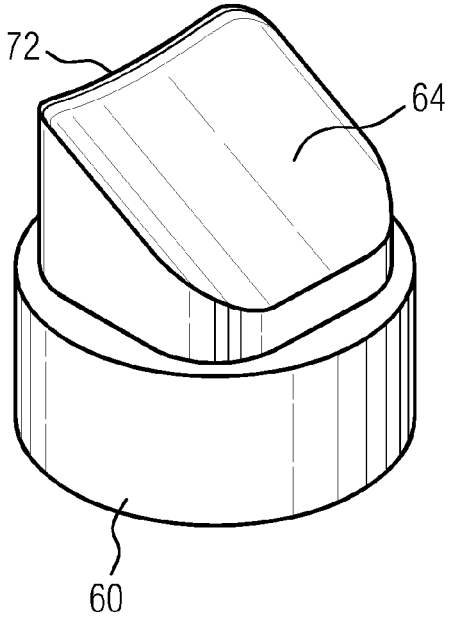
FIG. 9 shows a perspective view of the exemplary pin of FIG. 8.

The spring-loaded pin 60 of the backing latch 32 or the radially inner end 94 includes a rounded tip 72, such that the pin 60 will not catch on an interface 110 between the male part 14 and the shuttle piston 18. FIG. 9 shows a three-dimensional perspective view of the pin 60.

Figure 10:
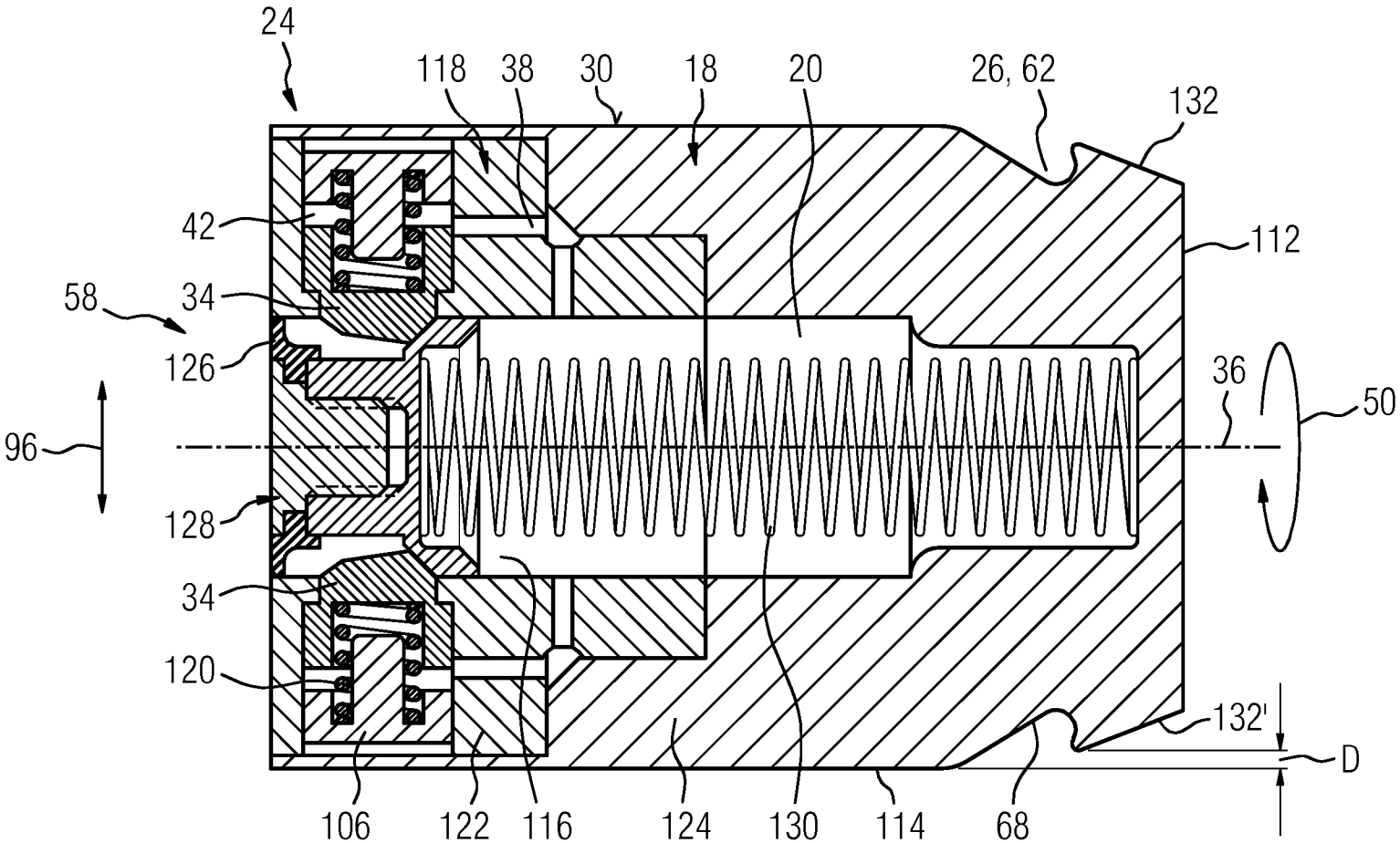
FIG. 10 shows a cross-sectional view of the exemplary shuttle piston of FIG. 1 with a latching device, a latching structure, and an opening with a dirt seal.

FIG. 10 shows a cross-section view of the shuttle piston 18. For interaction with the backing latch 32 of the female part 16, the shuttle piston 18 includes a latching structure 26 configured for forming the force-fitting and form-fitting connection between the shuttle piston 18 and the female part 16. The latching structure 26 is provided as a groove 62 extending in a circumferential direction 50 of the shuttle piston 18. In the mated position of the shuttle piston 18 and the female part 16, the spring-loaded pins 60 of the female part 16 are latched with the groove 62 of the shuttle piston 18 shown in FIG. 1.

Therefore, the groove 62 has a contour 68 that is complementary to a contour 70 (e.g., first chamfer 64 and second chamfer 66) of the spring-loaded pin 60 of the backing latch 32 shown in FIG. 8. In other words, the groove 62 has the same profile as a latch pin 60 to provide smooth engagement and disengagement. An end of the shuttle piston 18 towards the female part 16 and located adjacent to the groove 62 features a lip 112 that is radially recessed slightly about distance D, such that the lip 112 does not interfere with any of the other features (e.g., internal stress control moldings or a multilam in a female socket contact) within the female part 16.

Both the shuttle piston 18 and the male part 14 have an interaction area 30 configured for interaction in a force-fitting manner with the backing latch 32 of the female part 16. The interaction areas 30 are provided as first planar surface 30 and second planar surface 30' at a radially outer cylinder barrel 114 of the male part 14 and the shuttle piston 18. After insertion of the section 22 of the male part 14 into an opening 20 of the shuttle piston 18, the cylinder barrels 114 of both the male part 14 and the shuttle piston 18 end radially flush with each other. Hence, the transition between the planar surface 30 of the shuttle piston 18 and the planar surface 30' of the male part 14 build the smooth interface 110.

After dis-engagement of the backing latch pins 60 from the groove 62, the rounded tip 72 of the spring-loaded pin 60 first engages the planar surface 30 of the shuttle piston 18 in a force-fitting manner. As the male part 14 is further moved in the moving direction 88 into the female part 16, the rounded tip 72 engages the planar surface 30' of the male part 14 in a force-fitting manner. The force-fitting connection between the tip 72 of the backing latch pin 60 and the interaction areas (e.g., planar surfaces 30, 30') of the shuttle piston 18 and the male part 14 is configured such that a gliding motion of the tip 72 on the first planar surface 30 and second planar surface 30' is facilitated. The force-fitting connection may be a latching action.

The principal of operation for the backing latch is as follows. In the normal, unmated position, the shuttle piston 18 is prevented from moving easily by the latch pins 60 being engaged in the shuttle piston groove 62. Extrusion beyond the female part 16 would not happen without shearing all of the latch pins 60. To mate the male part 14 and the female part 16, a large enough force is applied such that the pins 60 will be pushed clear by the dis-engagement chamfer angle γ. Once fully mated, the backing latch 32 will not interfere with movements of the male part 14 or the shuttle piston 18 since the male part 14 and the shuttle piston 18 will be fully recessed. During the de-mating process, the pins 60 will be pushed into the shuttle piston groove 62, thereby locking the shuttle piston 18 into the original position.

To join the male part 14 and the shuttle piston 18 during the mating and de-mating processes, the shuttle piston 18 includes the opening 20 configured for receiving the section 22 (e.g., a protrusion) of the male part 14. To form a secure connection between the shuttle piston 18 and the male part 14, the shuttle piston 18 includes a latching device 24 configured for forming a force-fitting and form-fitting connection between the shuttle piston 18 and the male part 14. The latching device 24 is positioned at a front end 116 of the opening 20 of the shuttle piston 18. To provide a mechanical latch, spring-loaded angled pins 34 may be used to produce the latching effect.

Figure 11:
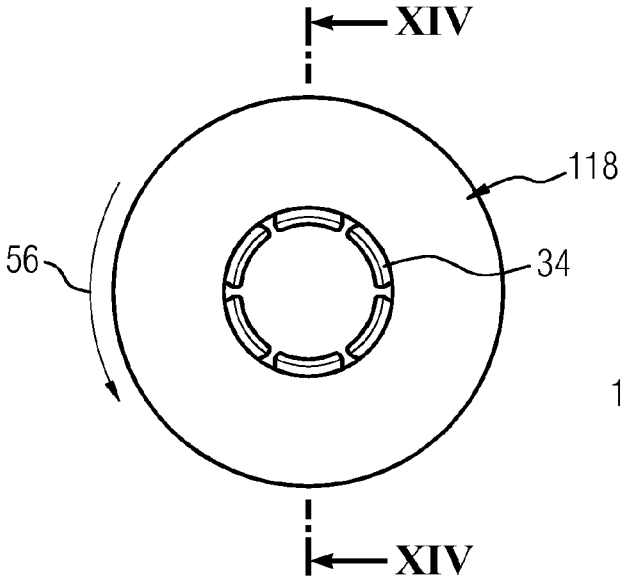
FIG. 11 shows a front view of an exemplary assembly holder from the latching device of FIG. 10.
Figure 12:
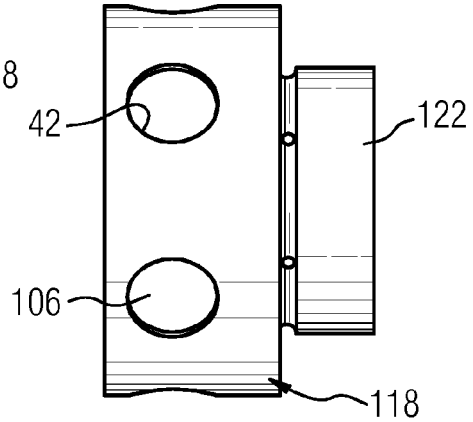
FIG. 12 shows a side view of the exemplary assembly holder of FIG. 11.
Figure 13:
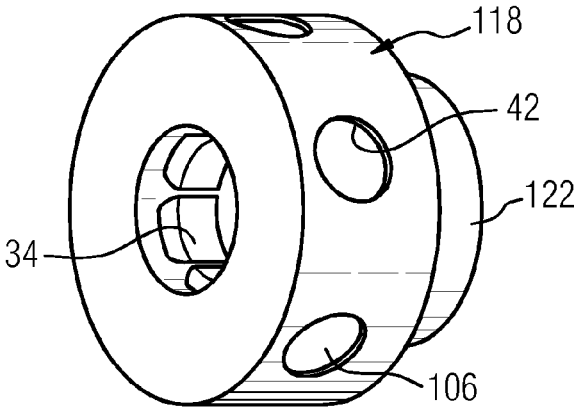
FIG. 13 shows a perspective view of the exemplary assembly holder of FIG. 11.

FIGS. 11 to 14 show an assembly holder 118 of the latching device 24 in various views. The assembly holder 118 is provided as an annular structure that extends, when mounted in the shuttle piston 18, in the circumferential direction 50 of the opening 20 of the shuttle piston 18 shown in FIG. 10. The latching device 24 includes a plurality of spring-loaded pins 34 that are evenly distributed along a circumference 56 of the assembly holder 118. FIG. 12 shows the assembly holder 118 in a side view, and FIG. 13 shows the assembly holder 118 in a three-dimensional perspective view.

Figure 14:
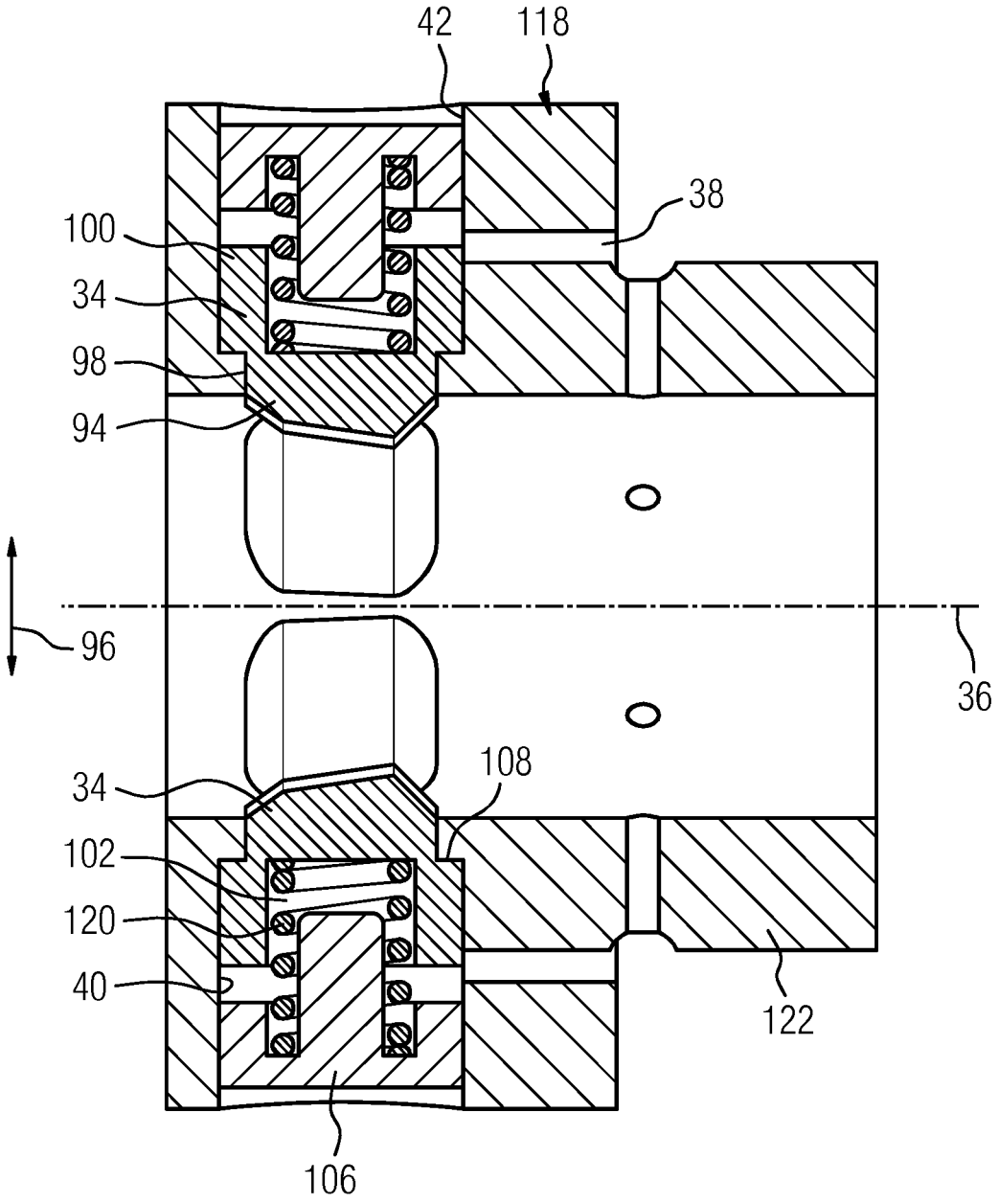
FIG. 14 shows a cross-section taken along line XIV-XIV through the exemplary assembly holder of FIG. 11.

FIG. 14 shows a cross-section through the assembly holder 118 taken along the line XIV-XIV in FIG. 11. Each spring-loaded pin 34 is arranged in a mounted state in the shuttle piston 18 basically radially with respect to an axis 36 of the shuttle piston 18 shown in FIG. 10. A radially inner end 94 of the pin 34 extends in radial direction 96 through a clearance 98 of the assembly holder 118. A radially outer end 100 of the pin 34 extends in a channel 42 and features a recess 102 configured to accommodate a spring 120 to bias the pin 34.

To construct the assembly, each latching device pin 34 is inserted into the channel 42 in the assembly holder 118, and the spring 120 is placed into the recess 102 behind the inner end 94. The spring 120 and the pin 34 are secured in place by a latch pin spring base 106 that is screwed into a thread (not shown in detail) in the holder 118. The base 106 is also used to apply the correct compression to the spring 120. A stepped flange 108 at a radially inner bottom of the channel 42 prevents the pin 34 from moving too far into the opening 20 of the shuttle piston 18. Furthermore, the stepped flange 108 is the same depth as the anticipated length of travel of the latching device pin 34. Thus, even when the pin 34 is fully depressed, a gap cannot open to allow sediment to get behind the pins 34. The latching device 24 or the assembly holder 118 includes a security device 38 in the form of a flow channel 38 that is equipped to carry water to prevent hydraulic locking of the spring-loaded pin 34. In case of water entering the channel 42 guiding the pin 34 during mating of the male part 14 and the shuttle piston 18, thereby blocking the radial movement of the pin 34, the water may exit the channel 42 via the security device 38 or the flow channel 38.

The assembly holder 118 further includes an axially rear portion 122 that, when mounted in the shuttle piston 18, is oriented towards the lip 112 and is used for connection with the shuttle piston 18. Therefore, the axially rear portion 122 is threaded for easy insertion into a shuttle piston shell 124 shown in FIG. 10. The shuttle piston shell 124 is machined out of a single piece of steel, such that there is a continuous, smooth surface. Thus, the front seals 80 of the female part 16 will maintain a good seal throughout the mate/de-mate process.

As shown in FIG. 10, the shuttle piston 18 includes a dirt seal 58 that is mounted in the opening 20 of the shuttle piston 18 to prevent entry of dirt into the shuttle piston 18. The purpose of the dirt seal 58 is to prevent ingress of sediment and grit into the opening 20 of the shuttle piston 18 where the material may interfere with the latch.

The dirt seal 58 is a rubber ring 126 mounted on a steel carriage 128 that includes a front section and a rear section. The dirt seal 58 is driven forwards by a light spring 130 positioned in the opening 20. The rubber ring 126 is flexible enough to pass the latching device pins 34 but stiff enough to remain upright at the front end 116 of the opening 20. The dirt seal carriage 128 will catch on the back of the latching device pins 34 to prevent the seal 58 from extruding beyond the opening 20 of the shuttle piston 18. The dirt seal 58 allows the latch to continue to operate (e.g., in dirty water).

Figure 15:
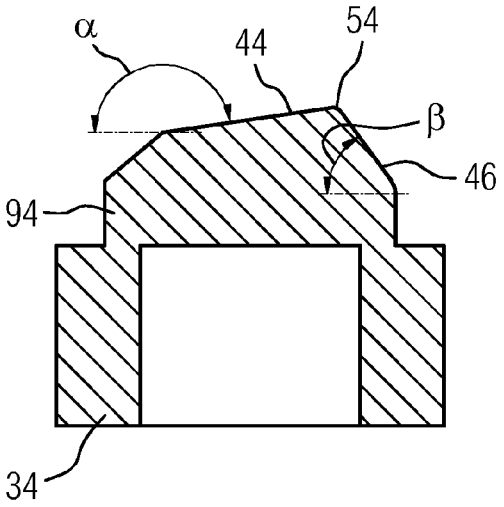
FIG. 15 shows a cross-sectional view through a pin of the exemplary latching device of FIG. 10.
Figure 16:
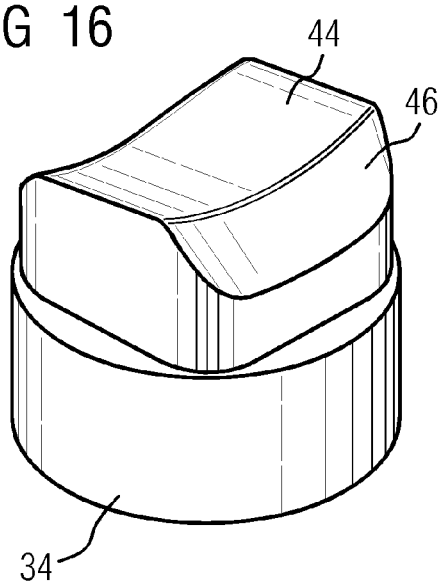
FIG. 16 shows a perspective view of the exemplary pin of FIG. 15.

FIG. 15 shows a cross-section of a pin 34. The pin 34 of the latching device 24 includes a mating chamfer 44 with angle α and a de-mating chamfer 46 with angle β. The angles α and β are selected for functions of the mating chamfer 44 and the de-mating chamfer 46. The angle α of the mating chamfer 44 is a gentle engagement angle with an inclination angle of about 170° with respect to the axis 36 of the shuttle piston 18. The angle β of the de-mating chamfer 46 is a steep dis-engagement angle with an inclination angle of about 55° with respect to the axis 36 of the shuttle piston 18 shown in FIG. 10. FIG. 16 shows a three-dimensional perspective view of the pin 34.

In a mounted state of the assembly holder 118, at the shuttle piston 18, the mating chamfer 44 for engagement faces towards the male part 14 (e.g., away from the lip 112), and the de-mating chamfer 46 for dis-engagement faces a contrariwise direction (e.g., towards the lip 112). The function of the mating chamfer 44 and the de-mating chamfer 46 is to allow mating and de-mating of the male part 14 from the shuttle piston 18. Thus, the latching device 24 of the shuttle piston 18 provides a releasable connection between the shuttle piston 18 and the male part 14. The force used to engage and disengage each pin 34 may be controlled through the two chamfer angles α and β and the stiffness and compression of the latching device spring 120. Larger forces may be achieved by increasing the chamfer angles α and β and by using a stiffer spring 120 under greater compression while lower forces may be gained by the opposite process.

Figure 17:
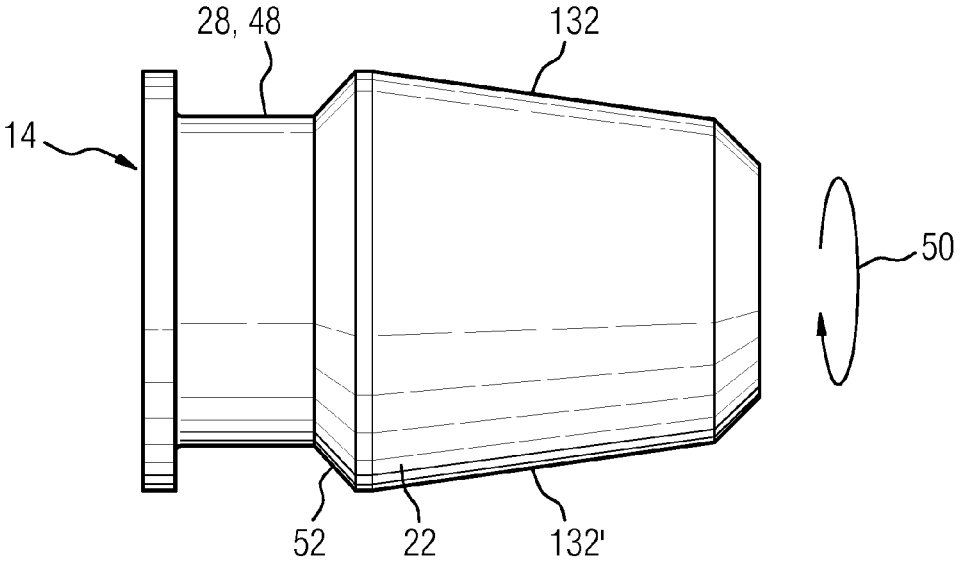
FIG. 17 shows a side view of a front section of the exemplary male part of FIG. 1 with a latching aid.

FIG. 17 shows a side view of the section 22 of the male part 14 in the form of a protrusion. For interaction with the latching device 24 of the shuttle piston 18, the male part 14 includes a latching aid 28 configured for forming the force-fitting and form-fitting connection between the male part 14 and the shuttle piston 18. The latching aid 28 is provided as a groove 48 extending in a circumferential direction 50 of the male part 14. In the mated position of the male part 14 and the shuttle piston 18, the groove 48 accommodates the spring-loaded pins 34 in a force-fitting and basically form-fitting manner. Alternatively, the spring-loaded pins 34 of the shuttle piston 18 are latched with the groove 48 of the male part 14.

Therefore, the groove 48 has a contour 52 that is complementary to a contour 54 (e.g., de-mating chamfer 46) of the spring-loaded pin 34 of the latching device 24 shown in FIG. 15. In other words, the groove 48 has the same profile as a latching device pin 34 to provide proper locking and smooth dis-engagement. Furthermore, the section 22 or the protrusion of the male part 14 has a first chamfer 132 and a second chamfer 132' with angles corresponding to the latching device pins 34 and the engagement angle α of the mating chamfer 44.

Figure 19:
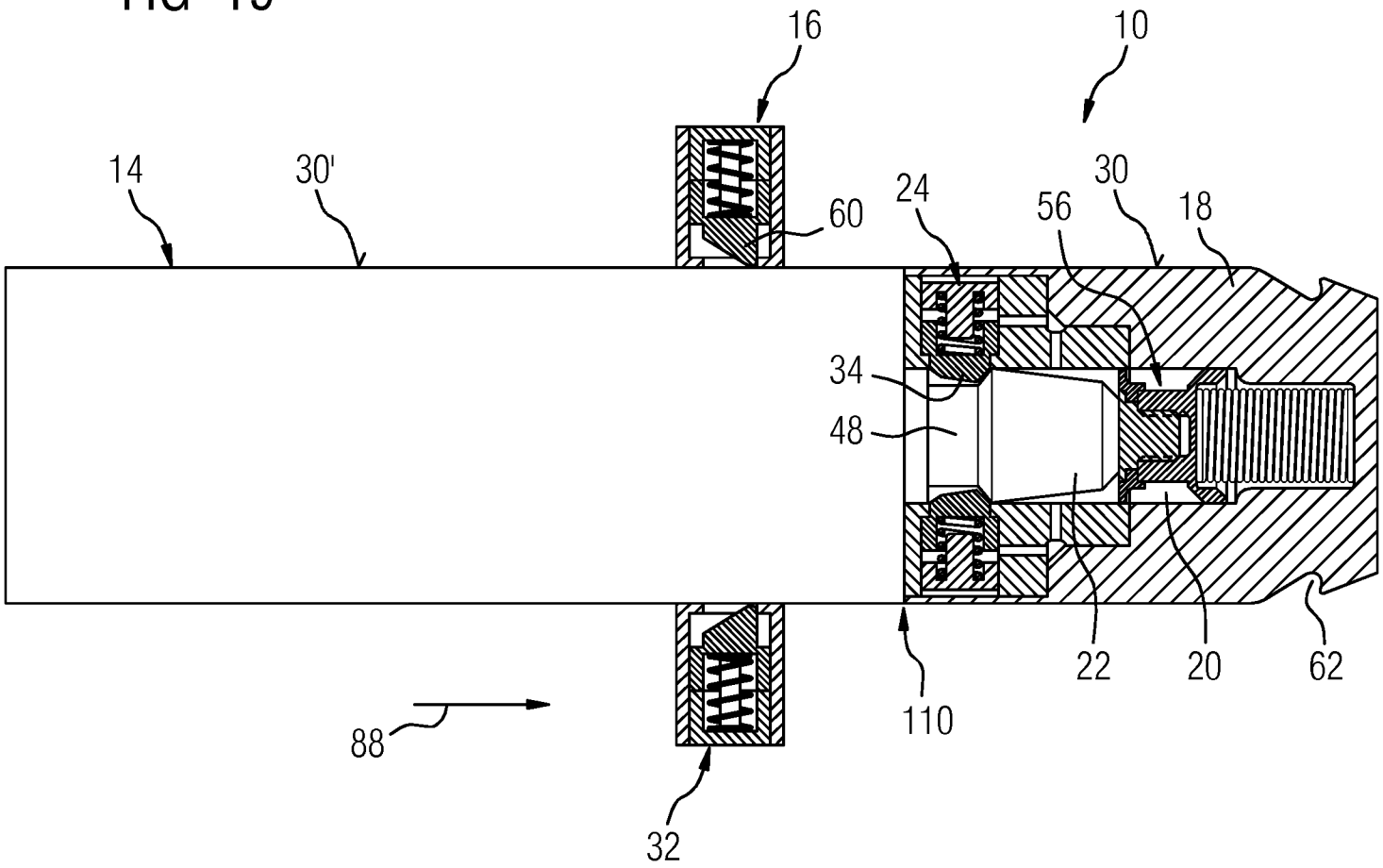
FIG. 19 shows a partial cross-sectional view of an exemplary male part with the connected exemplary shuttle piston after mating and dis-engagement from the exemplary female part.
Figure 20:
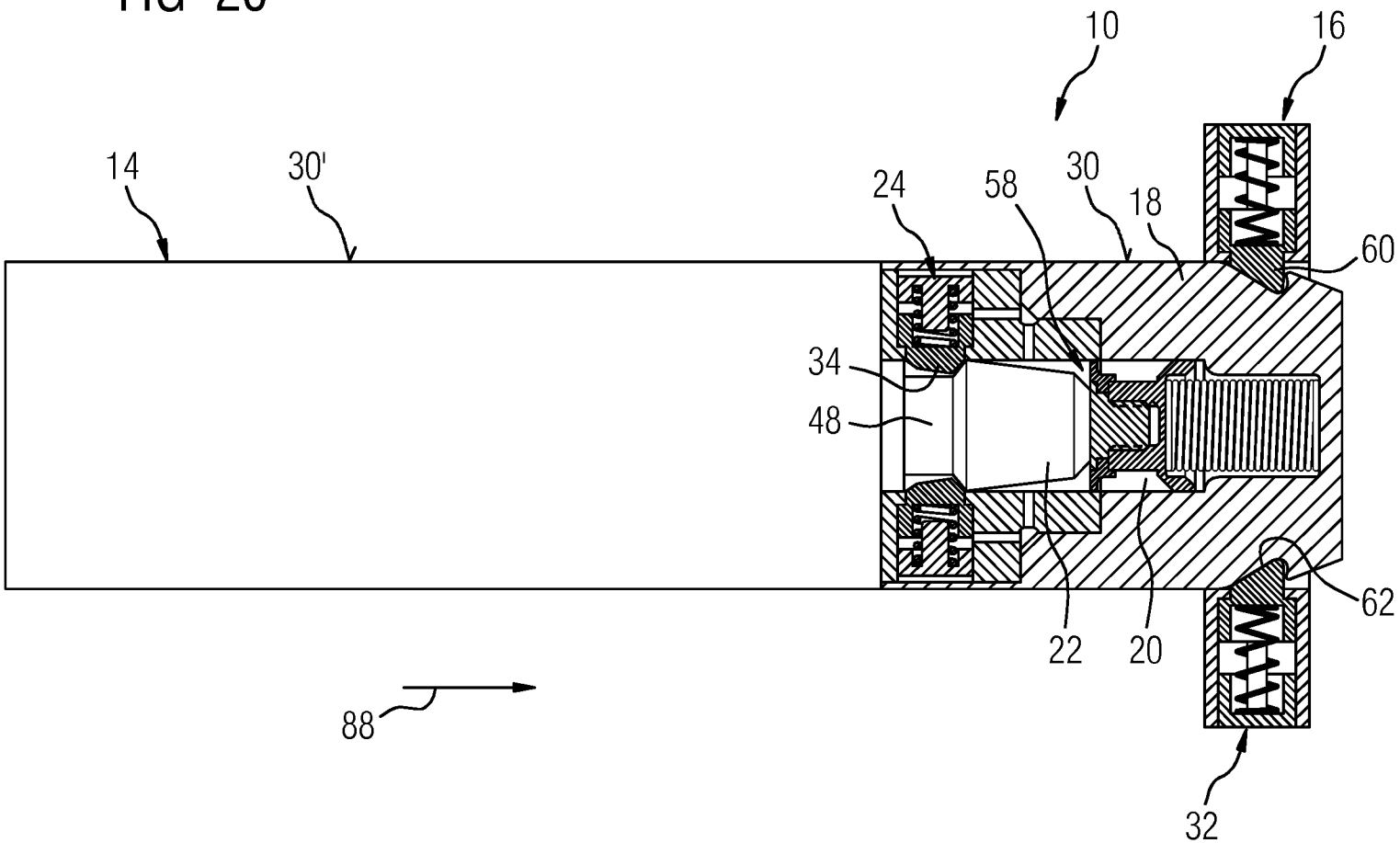
FIG. 20 shows a partial cross-sectional view of an exemplary male part with the connected exemplary shuttle piston after re-latching with the exemplary female part prior to de-mating of the male part from the shuttle piston.

In reference to FIGS. 18 to 20, a method for forming a connection between the male part 14 and the female part 16 of a connector unit 10 using the shuttle piston 18, as well as a method for releasing the connection between the male part 14 and the female part 16 of a connector unit 10 using the shuttle piston 18, will now be described. The female part 18 is represented by the assembly holder 92 of the backing latch 32. Moreover, for clarity, the male part 14 is shown without hatching.

Figure 18:
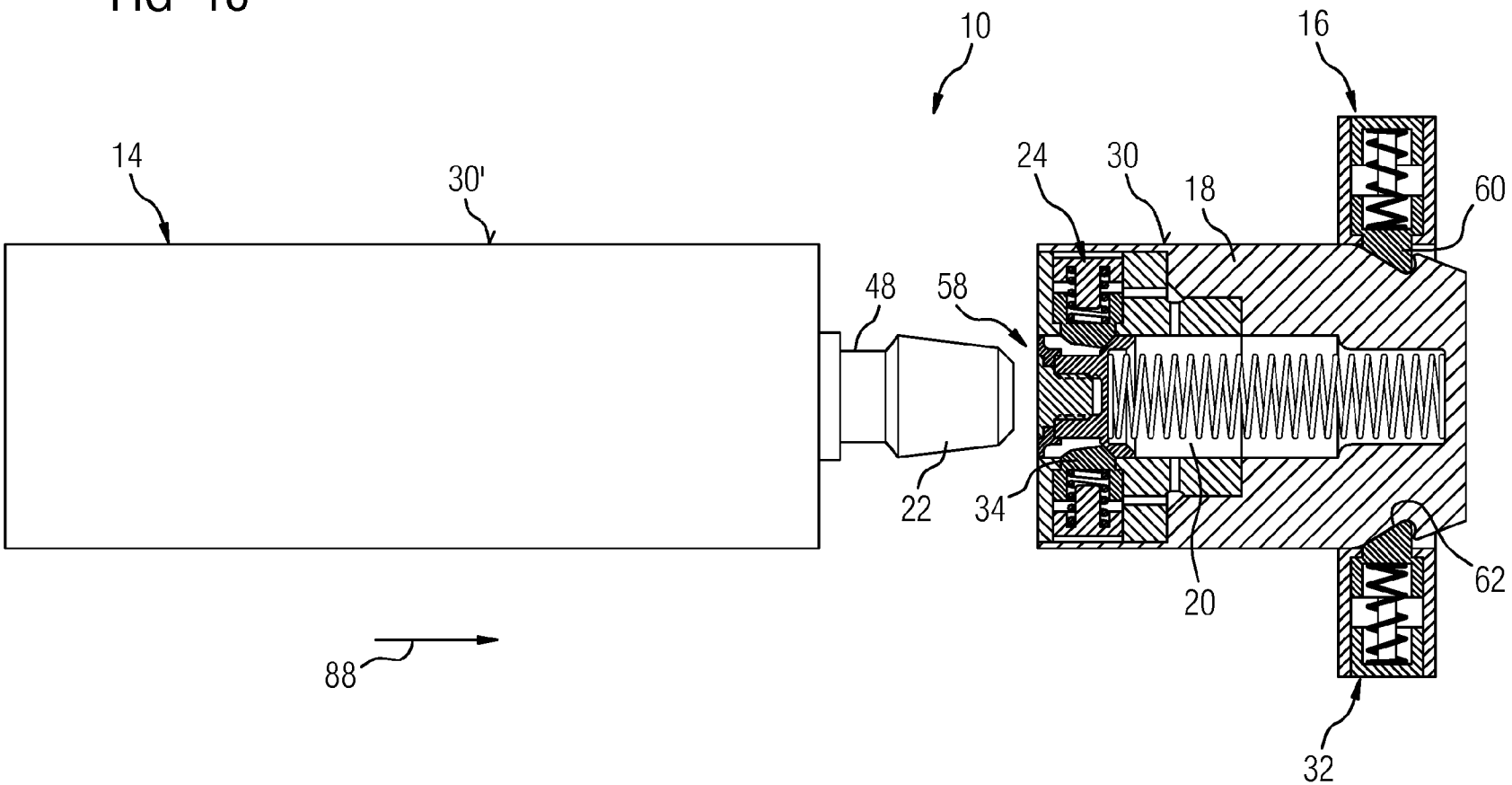
FIG. 18 shows a partial cross-sectional view of an exemplary male part and an exemplary shuttle piston connected to an exemplary female part prior to mating of the male part and the shuttle piston.

FIG. 18 shows the unmated state of the male part 14 and the shuttle piston 18. In this position, the shuttle piston 18 is prevented from moving easily by the backing latch pins 60 being engaged in the shuttle piston groove 62. Extrusion beyond the female part 16 (e.g., in the direction of the male part 14) would shear all of the backing latch pins 60. The dirt seal 58 is loaded by spring 120 in a forward position within the shuttle piston 18, thereby preventing dirt from entering the shuttle piston opening 20.

The section 22 of the male part 14 is pushed in the moving direction 88 into the opening 20 of the shuttle piston 18. The gentle engagement angle α of the mating/engagement chamfer 44, as well as an angle of the first chamfer 132 and second chamfer 132' of the section 22 shown in FIG. 17, allow the section 22 of the male part 14 to be easily inserted into the shuttle piston opening 20. The male part 14 is moved until the latching aid 26 or groove 48 engage with the pins 34 of the latching device 24 and a force-fitting and form-fitted connection between the shuttle piston 18 and the male part 14 is formed. The pins 34 are able to retreat into the channels 42 of the assembly holder 118, thereby compressing the spring 120. Hence, a fixed connection between the shuttle piston 18 and the male part 14 is provided.

To provide proper mating during insertion of the section 22 into the opening 20, the shuttle piston 18 is locally fixed in a force-fitting and form-fitting manner at the female part 16 by the latched backing latch pins 60 of the female part 16 in the latching structure 26 or groove 62 of the shuttle piston 18. Moreover, the engagement force for the latching device 24 is less than the dis-engagement force of the backing latch 32. As a result, the male part 14 and the shuttle piston 18 are bound together before entering the bore 78 of the female part 16.

After the latching of the latching device 24 with the latching structure 26, the male part 14 with the connected shuttle piston 18 is moved in the moving direction 88 relative to the female part 16. A larger force will allow the backing latch pins 60 to dis-engage from the groove 62 and the male part 14 and the shuttle piston 18 may enter the female part 16 securely bound together supported by the dis-engagement chamfer 64 of the pins 60 and a part of the contour 68 of the groove 62. The dis-engagement chamfer 64 of the pins 60 and the part of the contour 68 of the groove 62 are complementary. Hence, the force-fitting and form-fitting connection between the female part 16 and the shuttle piston 18 unlatches. The pins 60 may retreat into the channels 42 of the assembly holder 92, thereby compressing the spring 104. Consequently, the female part 16 or the rounded tip 72 of each pin 60 connects the planar surface 30 of the shuttle piston 18 in a force-fitting manner.

By pushing the male part 14 further into the bore 78 of the female part 16, the rounded tip 72 will cross the interface 110 between the shuttle piston 18 and the male part 14. The rounded tip 72 connects the planar surface 30' of the male part 14 in a force-fitting manner. Once fully mated, there is no impediment to the movement of the male part 14 and the shuttle piston 18, such that the male part 14 and the shuttle piston 18 remain bound together. As a result of this mating sequence, a fixed connection between the male part 14 and the female part 16 is provided. FIG. 19 shows the connector unit 10 after mating of the male part 14 with the shuttle piston 18 and dis-engagement of the male part 14 and the shuttle piston 18 from the female part 16. To secure the connection between the male part 14 and the female part 16, or to lock the male part 14 and the female part 16 further into the fully mated state, the connector unit 10 may include a securing element (e.g., a lock and/or a clamp) provided, for example, on external metalwork (not shown).

To dis-connect the male part 14 from the female part 16, the male part 14 with the connected shuttle piston 18 is moved or pulled against the moving direction 88 relative to the female part 16. The movement of the shuttle piston 18 is stopped by the reengaged latch between the pins 60 of the backing latch 32 and the groove 62 of the shuttle piston 18. The movement is mediated by the loosening of the spring 104 that pushes the pin 60 back into the groove 62 radially. Further, the locking is supported by the locking chamfer 66 of the pins 60 and a part of the contour 68 of the groove 62. The locking chamfer 66 of the pins 60 and the part of the contour 68 of the groove 62 are complementary. Thus, the force-fitting and form-fitting connection between the shuttle piston 18 and the female part 16 is re-formed, thereby providing a fixed connection between the shuttle piston 18 and the female part 16.

As stated above, the male part 14 is locally fixed in a force-fitting and form-fitting manner into the opening 20 of the shuttle piston 18 by a latching mechanism of the shuttle piston 18 during the movement of the male part 14 relative to the female part 16. FIG. 20 shows the connector unit 10 after reengagement of the shuttle piston 18 with the female part 16 prior to the de-mating of the male part 14 from the shuttle piston 18.

To dis-engage the connection between the male part 14 and the shuttle piston 18, the male part 14 is moved or pulled against the moving direction 88 relative to the shuttle piston 18 and, therefore, the female part 16. When a large force is applied, the latching device pins 34 dis-engage from the latching aid 28 or groove 48 of the male part 14, and the male part 14 may be removed. Hence, the force-fitting and form-fitting connection between the shuttle piston 18 and the male part 14 unlatches. The pins 34 may retreat into the channels 42 of the assembly holder 118, thereby compressing the spring 120, supported by the dis-engagement chamfer 46 of the pins 34 and a part of the contour 52 of the groove 48. The dis-engagement chamfer 46 of the pins 34 and the part of the contour 52 of the groove 48 are complementary. As a result of the de-mating sequence, the male part 14 is disconnected from the shuttle piston 18 or the female part 16, respectively (not shown in detail).

The shuttle piston 18 will be locked into the forward position at the front end 116, and the dirt seal 58 will move forwards, thereby preventing dirt from entering the opening 20 shown in FIG. 18.

It is to be understood that the term "comprising" does not exclude other elements or acts, and that the articles "a" and "an" do not exclude a plurality. In addition, elements described in association with different embodiments may be combined.

While the present invention has been described above by reference to various embodiments, it should be understood that many changes and modifications may be made to the described embodiments. It is therefore intended that the foregoing description be regarded as illustrative rather than limiting, and that it be understood that all equivalents and/or combinations of embodiments are intended to be included in this description.

It is to be understood that the elements and features recited in the appended claims may be combined in different ways to produce new claims that likewise fall within the scope of the present invention. Thus, whereas the dependent claims appended below depend from only a single independent or dependent claim, it is to be understood that these dependent claims may, alternatively, be made to depend in the alternative from any preceding claim—whether independent or dependent—and that such new combinations are to be understood as forming a part of the present specification.

The invention claimed is:

1. A connector unit, comprising:

a male part;

a female part; and a shuttle piston;

wherein the shuttle piston comprises:

an opening configured for receiving at least a section of the male part;

at least one latching device configured for forming at least a force-fitting connection between the shuttle piston and the male part; and at least one latching structure configured for forming at least a force-fitting connection between the shuttle piston and the female part;

wherein the male part comprises:

a section configured for insertion into the opening of the shuttle piston;

at least one latching aid configured for forming at least the force-fitting connection between the shuttle piston and the male part; and an interaction area configured for a force-fitting interaction with at least one backing latch of the female part; and wherein the female part comprises:

the at least one backing latch configured for forming at least the force-fitting connection between the shuttle piston and the female part, and further configured for interacting at least with the interaction area of the male part in a force-fitting interaction.

2. The connector unit of claim 1, wherein the at least one latching device comprises at least one spring-loaded pin that extends radially with respect to an axis of the shuttle piston.

3. The connector unit of claim 2, wherein the at least one latching device further comprises at least one security device comprising at least one flow channel configured to carry water to prevent hydraulic locking of the spring-loaded pin.

4. The connector unit of claim 1, wherein the at least one latching device comprises at least one mating chamfer having an engagement angle with respect to an axis of the shuttle piston, wherein the engagement angle has a value between 179° and 160.

5. The connector unit of claim 1, wherein the at least one latching device comprises at least one de-mating chamfer having a dis-engagement angle with respect to an axis of the at least one shuttle piston, wherein the dis-engagement angle has a value between 30° and 85°.

6. The connector unit of claim 2, wherein the at least one latching aid of the male part comprises at least one groove that extends in a circumferential direction of the male part, wherein the at least one groove is configured to accommodate the spring-loaded pin by a force-fit.

7. The connector unit of claim 6, wherein the at least one groove comprises a contour that is complementary to at least one contour of the spring-loaded pin.

8. The connector unit of claim 1, wherein the at least one latching device comprises a plurality of spring-loaded pins evenly distributed along an inner circumference of the shuttle piston.

9. The connector unit of claim 1, wherein the shuttle piston further comprises at least one dirt seal mounted in the opening of the shuttle piston and configured to prevent entry of dirt into the shuttle piston.

10. The connector unit of claim 1, wherein the at least one backing latch of the female part is configured to provide a releasable connection between the shuttle piston and the female part.

11. The connector unit of claim 10, wherein:

the at least one backing latch comprises at least one spring-loaded pin that extends radially with respect to an axis of the female part;

wherein the at least one latching structure of the shuttle piston comprises at least one groove that extends in a circumferential direction of the shuttle piston; or wherein the at least one backing latch comprises at least one spring-loaded pin that extends radially with respect to the axis of the female part, and wherein the at least one latching structure of the shuttle piston comprises at least one groove that extends in the circumferential direction of the shuttle piston;

wherein the spring-loaded pin of the female part is configured to latch with the at least one groove of the shuttle piston.

12. The connector unit of claim 11, wherein the at least one backing latch further comprises at least one chamfer, and wherein the at least one groove of the shuttle piston comprises a contour that is complementary to a contour of the spring-loaded pin of the backing latch.

13. The connector unit of claim 11, wherein:

the spring-loaded pin of the at least one backing latch comprises at least one rounded tip;

wherein the shuttle piston, the male part, or the shuttle piston and the male part comprise at least one planar surface; or wherein the spring-loaded pin of the at least one backing latch comprises at least one rounded tip, and wherein the shuttle piston, the male part, or the shuttle piston and the male part comprise at least one planar surface;

wherein the at least one rounded tip of the spring-loaded pin is configured to engage the at least one planar surface by a force-fit.

14. The connector unit of claim 4, wherein the engagement angle has a value between 175° and 165°.

15. The connector unit of claim 4, wherein the engagement angle has a value between 173° and 171°.

16. A method for forming a connection between a male part and a female part of a connector unit, the connector unit comprising a shuttle piston, the method comprising:

pushing at least a section of the male part into an opening of the shuttle piston until at least a force-fitting connection between the shuttle piston and the male part is formed by a latching mechanism of the shuttle piston, thereby providing a fixed connection between the shuttle piston and the male part, wherein the shuttle piston is locally fixed in at least a force-fitting interaction at the female part by a backing latch of the female part during the pushing of the section of the male part into the opening of the shuttle piston; and moving the male part with the connected shuttle piston relative to the female part, thereby unlatching at least the force-fitting interaction between the female part and the shuttle piston until the female part connects at least the shuttle piston in a force-fitting interaction, thereby providing a fixed connection between the male part and the female part.

17. A method for releasing a connection between a male part and a female part of a connector unit, the connector unit comprising a shuttle piston, the method comprising:

moving the male part with the connected shuttle piston relative to the female part until at least a force-fitting connection between the shuttle piston and the female part is formed by a backing latch of the female part, thereby providing a fixed connection between the shuttle piston and the female part, wherein the male part is locally fixed in at least a force-fitting interaction in an opening of the shuttle piston by a latching mechanism of the shuttle piston during the moving of the male part relative to the female part; and moving the male part relative to the shuttle piston or the female part until at least the force-fitting interaction between the shuttle piston and the male part formed by the latching mechanism of the shuttle piston is unlatched, thereby disconnecting the male part from the female part.

18. The connector unit of claim 4, wherein the engagement angle has a value of about 172°.

19. The connector unit of claim 5, wherein the dis-engagement angle has a value between 40° and 60°.

20. The connector unit of claim 5, wherein the dis-engagement angle has a value between 45° and 55°.

21. The connector unit of claim 5, wherein the dis-engagement angle has a value of about 50°.

* * * * *